US012285647B2

(12) United States Patent
Tsai

(10) Patent No.: US 12,285,647 B2
(45) Date of Patent: Apr. 29, 2025

(54) ROTATION EXERCISING BALL STRUCTURE SWINGING SMOOTHLY

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 206 days.

(21) Appl. No.: 18/329,683

(22) Filed: Jun. 6, 2023

(65) Prior Publication Data

US 2024/0408437 A1 Dec. 12, 2024

(51) Int. Cl.

| | |
|---|---|
| ***A63B 21/22*** | (2006.01) |
| ***A63B 21/00*** | (2006.01) |
| ***A63B 43/00*** | (2006.01) |
| ***A63B 43/02*** | (2006.01) |

(52) U.S. Cl.

CPC ..... *A63B 21/222* (2015.10); *A63B 21/4035* (2015.10); *A63B 43/004* (2013.01); *A63B 43/02* (2013.01); *A63B 2209/08* (2013.01); *A63B 2220/58* (2013.01); *A63B 2225/50* (2013.01)

(58) Field of Classification Search

CPC . A63B 21/222; A63B 21/4035; A63B 43/004; A63B 43/02; A63B 2209/08; A63B 2220/58; A63B 2225/50; A63B 2220/833; A63B 21/0608; A63B 21/22

See application file for complete search history.

(56) References Cited

U.S. PATENT DOCUMENTS

| | | | | |
|---|---|---|---|---|
| 4,640,508 | A * | 2/1987 | Escher | A63B 23/03508 482/110 |
| 6,053,846 | A * | 4/2000 | Lin | A63B 21/22 482/44 |
| 7,175,573 | B1 * | 2/2007 | Huang | A63B 21/0004 446/236 |
| 7,686,740 | B1 * | 3/2010 | Chang | A63B 21/0608 482/50 |
| 12,029,933 | B2 * | 7/2024 | Tsai | A63B 21/0004 |
| 2007/0207899 | A1 * | 9/2007 | Chuang | A63B 23/14 482/44 |
| 2016/0367852 | A1 * | 12/2016 | Chuang | A63B 21/222 |
| 2017/0106249 | A1 * | 4/2017 | Marton | A63B 21/00178 |
| 2022/0193478 | A1 * | 6/2022 | Tsai | A63B 21/222 |
| 2024/0066346 | A1 * | 2/2024 | Tsai | A63B 21/4047 |

* cited by examiner

*Primary Examiner* — Andrew S Lo

(74) *Attorney, Agent, or Firm* — Chun-Ming Shih; LANWAY IPR SERVICES

(57) ABSTRACT

A rotation exercising ball structure includes two shells, two pivot seats, a weight unit, and two handle protecting members. The two shells are combined to construct a hollow ball. Each of the two shells has a space. Each of the two pivot seats is formed on the space and has a through hole. The weight unit includes a mandrel, a rotation member, two bearings, and a weight. The mandrel has two ends each secured in the through hole of one of the two pivot seats. The rotation member has a first end provided with a mounting hole for mounting the two bearings. The weight connects a second end of the rotation member. The rotation member and the weight are rotated on the mandrel. The two handle protecting members are mounted on the two shells.

11 Claims, 9 Drawing Sheets

ROTATION EXERCISING BALL STRUCTURE SWINGING SMOOTHLY

BACKGROUND OF THE INVENTION

Field of the Invention

The present invention relates to an exercising device and, more particularly, to a rotation (or gyration) exercising ball structure that swings smoothly.

Description of the Related Art

A conventional rotation structure was disclosed in the U.S. Publication No. 20220193478, and comprises a main body 10, two bearings 34 mounted in the main body 10, a mandrel 30 mounted between the two bearings 34, a rotation member 32 having a first end connected with the mandrel 30, and a weight 36 mounted on a second end of the rotation member 32. The main body 10 includes two shells 20 and 21 combined together. The main body 10 has an exterior provided with two operation portions 14. The main body 10 has an interior provided with a receiving chamber 22 and two mounting recesses 24. The weight 36 is rotatable in the receiving chamber 22. The two bearings 34 are mounted in the two mounting recesses 24. In operation, the user's two hands hold and move the two operation portions 14 so that the main body 10 is rotated, and the rotation member 32 and the weight 36 are pivoted about the mandrel 30 to produce a centrifugal force. At this time, the two operation portions 14 function as a pivot fulcrum. In such a manner, the user's two hands have to overcome the centrifugal force produced by the weight 36 so as to achieve an exercising effect.

However, the conventional rotation structure has the following disadvantages.

1. A T-shaped construction is defined between the mandrel 30 and the rotation member 32, and the mandrel 30 is rotated with its two ends served as fulcrums. In such a manner, the two ends of the mandrel 30 and the weight 36 form a triangular structure, so that when a force is applied on the main body 10, the force has to swing the mandrel 30, the rotation member 32, and the weight 36. Thus, the mandrel 30 applies a larger resistance so that the user cannot swing the main body 10 smoothly.

2. The two ends of the mandrel 30 are disposed in the two shells 20 and 21. Thus, when the two shells 20 and 21 are not assembled exactly, the two ends of the mandrel 30, the two bearings 34, and the two mounting recesses 24 are not located at the same central line, so that the mandrel 30 is not rotated smoothly.

3. The manufacturer has to assemble the two shells 20 and 21 carefully to keep the two ends of the mandrel 30, the two bearings 34, and the two mounting recesses 24 at the same central line, thereby prolonging the time of assembly, and thereby increasing the cost.

4. The conventional rotation structure has many parts with complicated procedures of assembly, thereby increasing the cost of fabrication and production.

BRIEF SUMMARY OF THE INVENTION

The primary objective of the present invention is to provide a rotation exercising ball structure that achieves an exercising effect by a centrifugal rotating motion.

In accordance with the present invention, there is provided a rotation exercising ball structure comprising two shells, two pivot seats, two holding members, a weight unit, and two handle protecting members. The two shells are combined together to construct a hollow ball. Each of the two shells has an interior provided with a space. The space has a bottom provided with a fixing hole. The fixing hole is located at a center of the bottom of the space and penetrates each of the two shells. Each of the two pivot seats is formed on the bottom of the space and directed toward an opening of one of the two shells. Each of the two pivot seats is provided with a pivot pillar. The pivot pillar has a center provided with a through hole. The through hole penetrates each of the two pivot seats and extends to the fixing hole. The two holding members are mounted on the two shells respectively. Each of the two holding members covers the fixing hole of one of the two shells. Each of the two holding members has an inner side and an outer side. The weight unit includes a mandrel, a rotation member, two bearings, a weight, and at least one auxiliary weight. The mandrel has two ends each of which extends through the through hole of one of the two pivot seats. Each of the two ends of the mandrel is secured in the through hole of one of the two pivot seats. The rotation member has a first end provided with a mounting hole. The two bearings are mounted in the mounting hole of the rotation member. The rotation member is radially mounted on a central position of the mandrel through the mounting hole. The weight connects a second end of the rotation member and is located opposite to the mandrel. The rotation member and the weight are rotated in the hollow ball radially and centrifugally with the mandrel served as an axis. The at least one auxiliary weight is removably mounted on the weight. The two handle protecting members are mounted on the two shells of the hollow ball respectively and align with the two holding members respectively.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
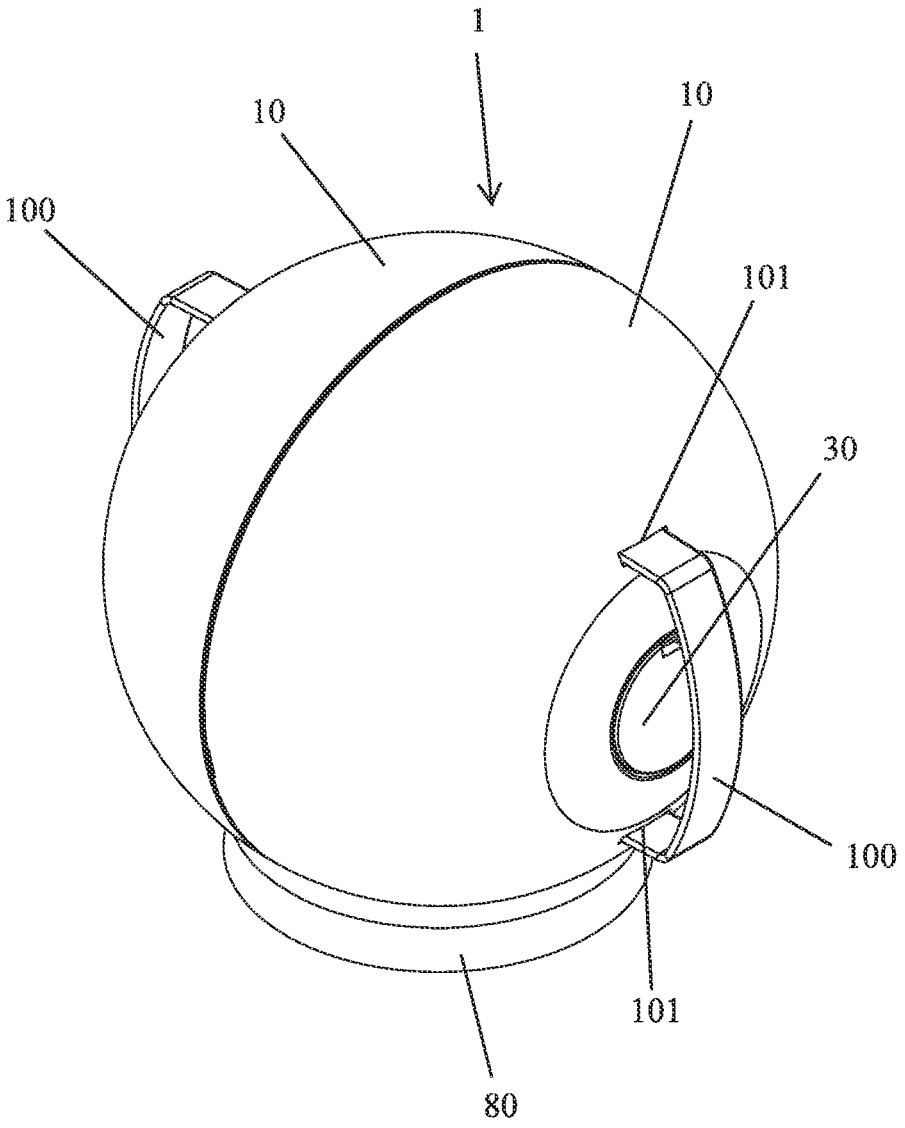
FIG. 1 is a perspective view of a rotation exercising ball structure in accordance with the preferred embodiment of the present invention.

Referring to the drawings and initially to FIGS. 1-7, a rotation exercising ball structure in accordance with the preferred embodiment of the present invention comprises two shells 10, two pivot seats (or mounting seats) 20, two holding members 30, a weight unit 40, and two handle protecting members 100.

The two shells 10 are combined together to construct a hollow ball 1. Each of the two shells 10 has an interior provided with a space 11. The space 11 has a bottom provided with a fixing hole (or securing hole) 12. The fixing hole 12 is located at a center of the bottom of the space 11 and penetrates each of the two shells 10.

Each of the two pivot seats 20 is formed on the bottom of the space 11 and directed toward an opening of one of the two shells 10. Each of the two pivot seats 20 is provided with a pivot pillar 22 protruding outward therefrom. The pivot pillar 22 has a center provided with a through hole 21. The through hole 21 penetrates each of the two pivot seats 20 and extends to the fixing hole 12.

The two holding members 30 are mounted on the two shells 10 respectively. Each of the two holding members 30 covers the fixing hole 12 of one of the two shells 10. Each of the two holding members 30 has an inner side and an outer side.

The weight unit 40 includes a mandrel 41, a rotation member 43, two bearings 42, a weight 44, and at least one auxiliary weight 441.

The mandrel 41 has two ends each of which extends through the through hole 21 of one of the two pivot seats 20. Each of the two ends of the mandrel 41 is secured in the through hole 21 of one of the two pivot seats 20.

The rotation member 43 has a first end provided with a mounting hole 47. The two bearings 42 are mounted in the mounting hole 47 of the rotation member 43 and rotatably disposed between the rotation member 43 and the mandrel 41. The rotation member 43 is radially mounted on a central position of the mandrel 41 through the mounting hole 47.

The weight 44 connects a second end of the rotation member 43 and is located opposite to the mandrel 41. The rotation member 43 and the weight 44 are rotated in the hollow ball 1 radially and centrifugally with the mandrel 41 served as an axis.

The at least one auxiliary weight 441 is removably mounted on the weight 44.

The two handle protecting members 100 are mounted on the two shells 10 of the hollow ball 1 respectively and align with the two holding members 30 respectively.

In the preferred embodiment of the present invention, the hollow ball 1 is mounted on and supported by a base 80.

In the preferred embodiment of the present invention, multiple first reinforcing ribs 17 are formed between one of the two pivot seats 20 and one of the two shells 10.

In the preferred embodiment of the present invention, multiple second reinforcing ribs 18 are formed between one of the two pivot seats 20 and the pivot pillar 22.

In the preferred embodiment of the present invention, each of the two holding members 30 is provided with an elastic locking snap 33 and a locking block 34. The elastic locking snap 33 and the locking block 34 are locked in the fixing hole 12 of one of the two shells 10.

In the preferred embodiment of the present invention, each of the two ends of the mandrel 41 initially extends through the through hole 21 of one of the two pivot seats 20, and then one of two nuts 45 is screwed onto each of the two ends of the mandrel 41 and locked onto one of the two pivot seats 20, so that each of the two ends of the mandrel 41 is secured in the through hole 21 of one of the two pivot seats 20.

In the preferred embodiment of the present invention, the at least one auxiliary weight 441 is locked onto and combined with a bottom of the weight 44 by screws.

In the preferred embodiment of the present invention, the at least one auxiliary weight 441 is locked onto and combined with a top of the weight 44 by screws.

In the preferred embodiment of the present invention, the rotation exercising ball structure further comprises a housing 51 mounted on and combined with the inner side of one of the two holding members 30, a Bluetooth transmission device 53 mounted in the housing 51, a Hall sensor (or transducer) 54 mounted on the mandrel 41, and two magnets 46 mounted on the rotation member 43. The housing 51 is inserted into the fixing hole 12 of one of the two shells 10. The Bluetooth transmission device 53 is electrically connected with the Hall sensor 54. The Hall sensor 54 is close to the mounting hole 47 of the rotation member 43 and aligns with the two magnets 46. The two magnets 46 are arranged at a periphery of the mounting hole 47.

In practice, when the rotation member 43 is rotated, the Hall sensor 54 detects rotation of the two magnets 46 and sends information or data of rotation of the two magnets 46 to the Bluetooth transmission device 53.

In the preferred embodiment of the present invention, each of the two shells 10 of the hollow ball 1 is provided with at least one connecting hole 101, and each of the two handle protecting members 100 is secured on the at least one connecting hole 101 of one of the two shells 10.

In the preferred embodiment of the present invention, each of the two bearings 42 is a rolling bearing or a sliding bearing.

In operation, a user's two hands hold the outer sides of the two holding members 30 to rotate and swing the hollow ball 1 reciprocally. At this time, the linear distance between the user's two palms is served as a fulcrum of the revolving shaft. In such a manner, when the hollow ball 1 is rotated, the weight 44 is revolved in the hollow ball 1 and produces an inertia centrifugal force (or a non-linear inertia G force) so that the user has to apply a resistant force to counteract the centrifugal force, thereby achieving an exercising effect. The most important feature is in that, the mandrel 41 is fixed without rotation, and the rotation member 43 is rotated about the mandrel 41 radially and centrifugally. At the same time, when the rotation member 43 is rotated, the two magnets 46 arranged on the mounting hole 47 of the rotation member 43 are also rotated in concert with the rotation member 43. Thus, when the two magnets 46 are rotated, the Hall sensor 54 mounted on the mandrel 41 will detect the information (or data) during rotation of the two magnets 46 (or the rotation member 43) and transmits the information to the Bluetooth transmission device 53. Finally, the Bluetooth transmission device 53 wirelessly transmits the information to an external portable electronic device, such as a smart phone or a tablet computer.

Figure 8:
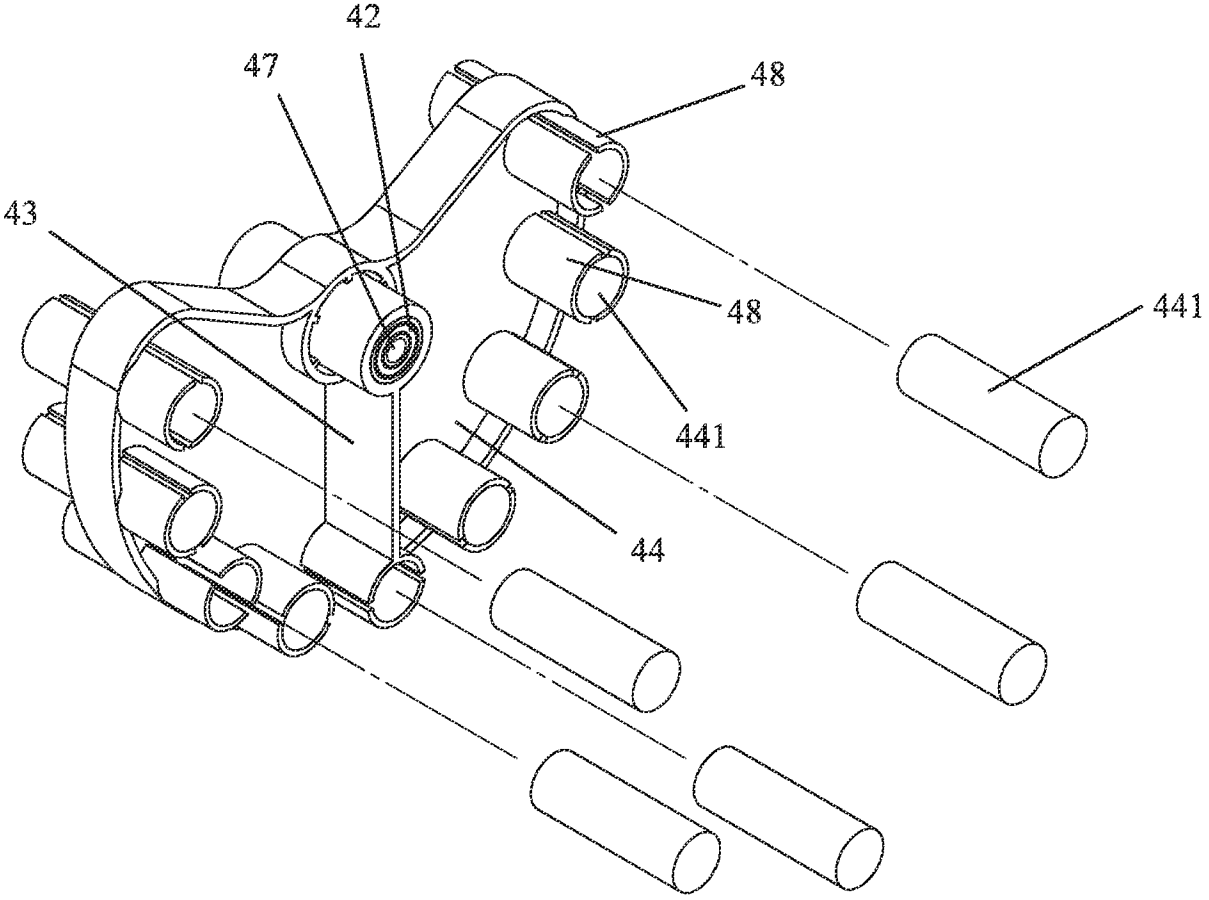
FIG. 8 is an exploded perspective view of a weight of the rotation exercising ball structure in accordance with another preferred embodiment of the present invention.
Figure 9:
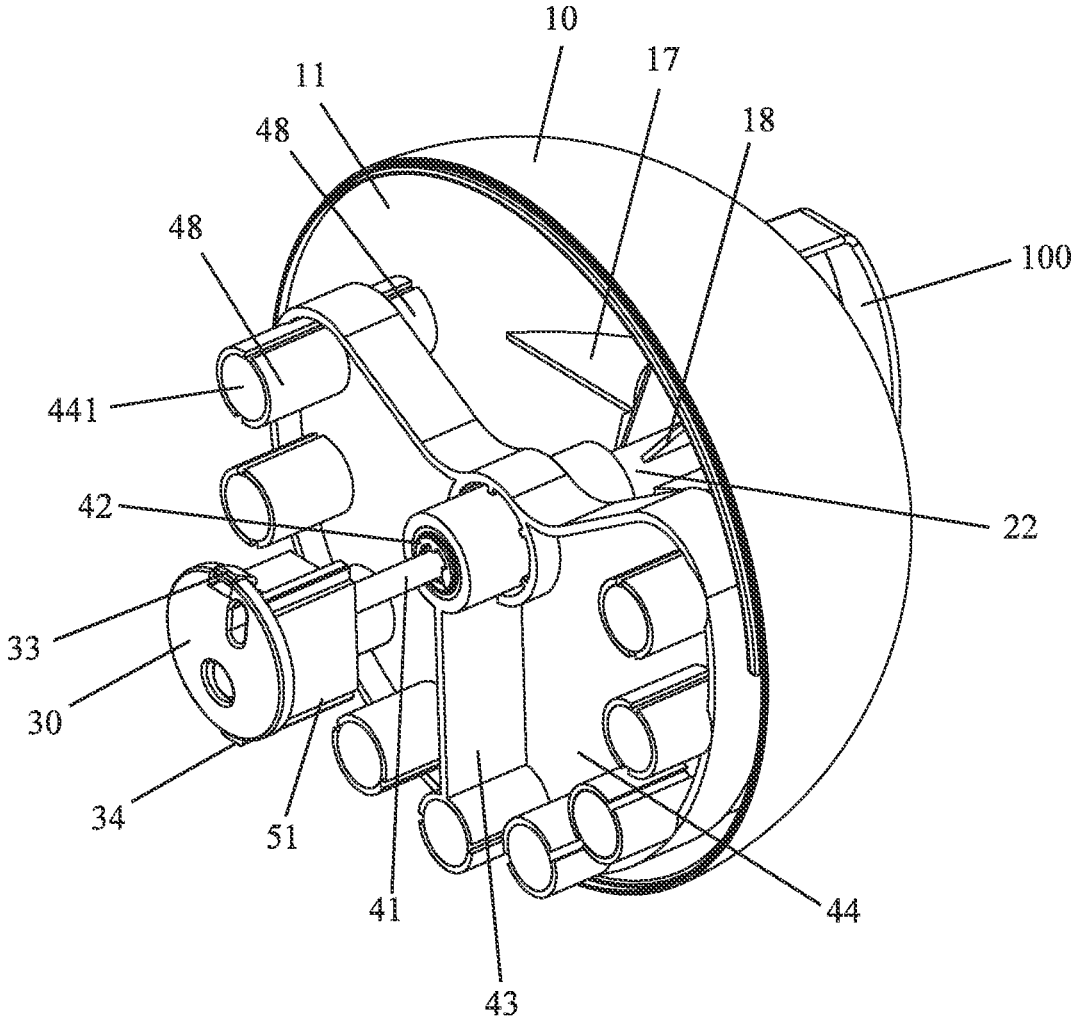
FIG. 9 is a partial exploded perspective view of the rotation exercising ball structure using the weight in accordance with another preferred embodiment of the present invention.

Referring to FIGS. 8 and 9 with reference to FIGS. 1-7, the weight 44 is provided with multiple receiving grooves 48. Each of the receiving grooves 48 transversely penetrates the weight 44. The weight unit 40 includes multiple auxiliary weights 441 mounted in the receiving grooves 48. Thus, the number of the auxiliary weights 441 is adjusted according to the user's requirement to increase or decrease the swinging centrifugal force of the weight 44.

Accordingly, the rotation exercising ball structure has the following advantages.

1. The two bearings 42 are mounted in the mounting hole 47 of the rotation member 43 so that the rotation member 43 is rotated on the mandrel 41 quietly without producing sound to prevent from causing noise during rotation. Thus, the user can exercise at any time.

2. The mandrel 41 is fixed without rotation, and only the rotation member 43 is rotated about the mandrel 41 reciprocally, to reduce the resistance when the rotation member 43 and the weight 44 are rotated centrifugally, so that the user operates and swings the hollow ball 1 easily and smoothly.

3. Each of the two ends of the mandrel 41 is secured in the through hole 21 of one of the two pivot seats 20 so that the mandrel 41 is fixed without rotation. Thus, when the two shells 10 are assembled, the mandrel 41 and the two pivot seats 20 are connected easily and conveniently, without having to align the mandrel 41 with the through hole 21 of each of the two pivot seats 20.

Figure 2:
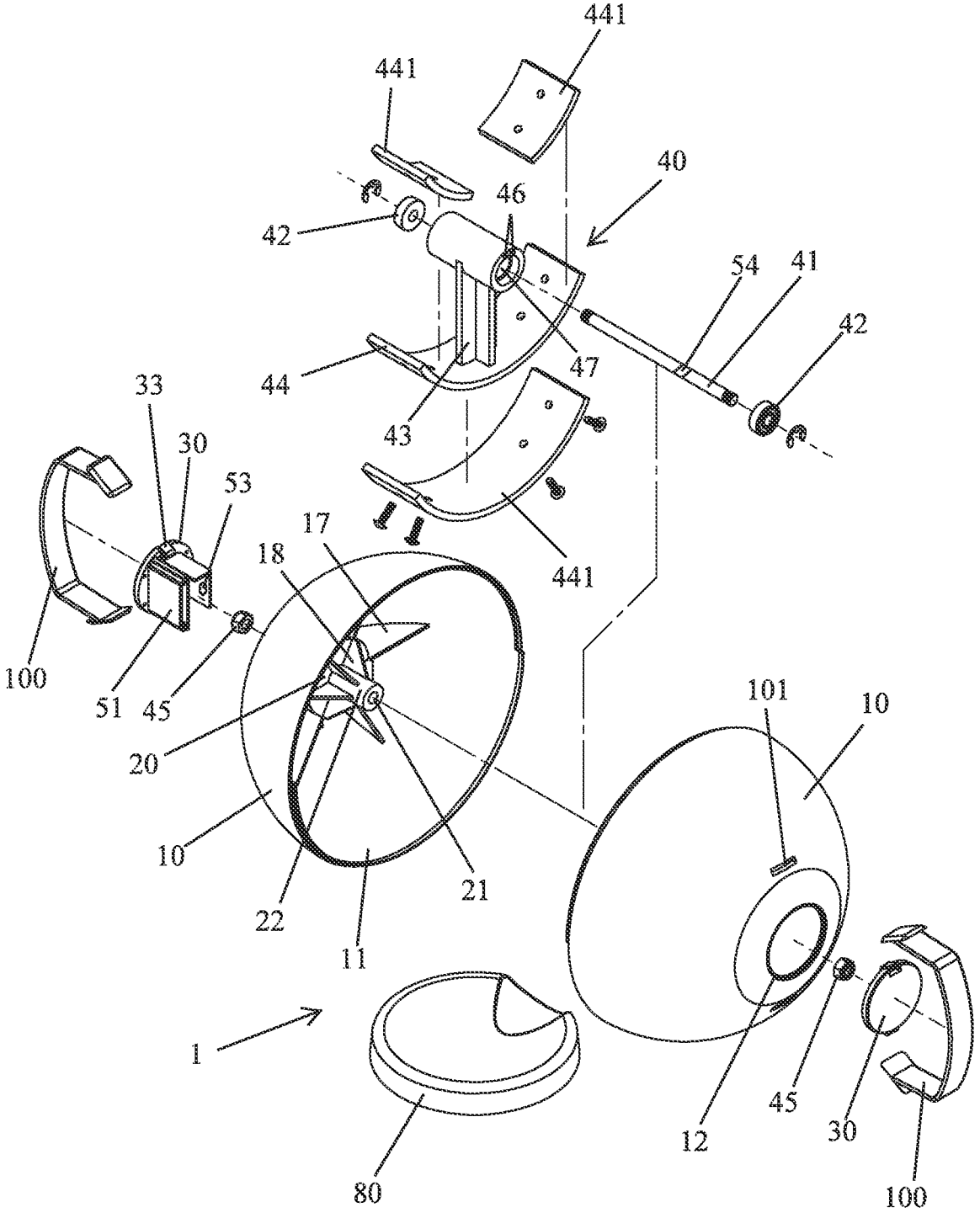
FIG. 2 is an exploded perspective view of the rotation exercising ball structure in accordance with the preferred embodiment of the present invention.
Figure 3:
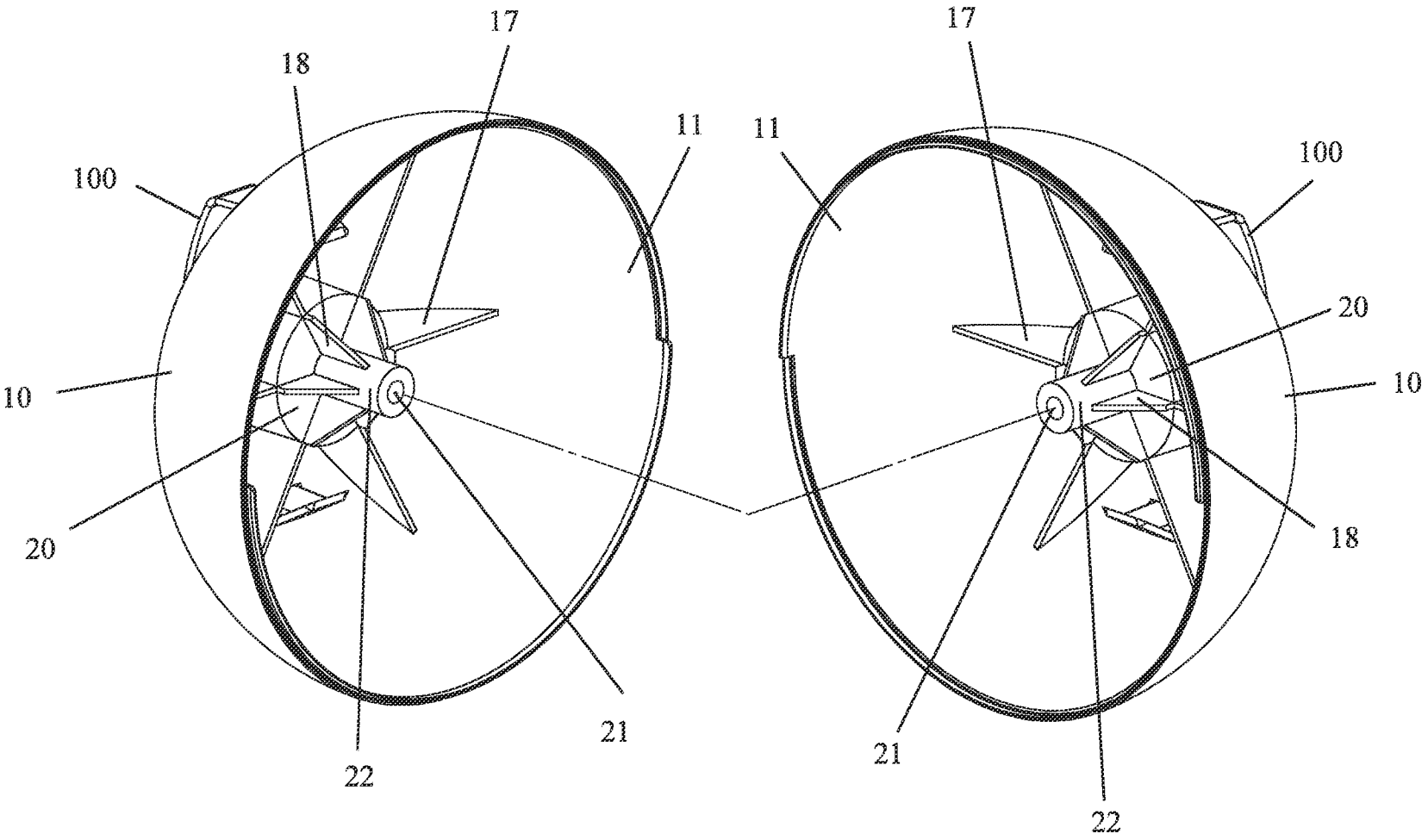
FIG. 3 is a partial exploded perspective view of the rotation exercising ball structure in accordance with the preferred embodiment of the present invention.
Figure 4:
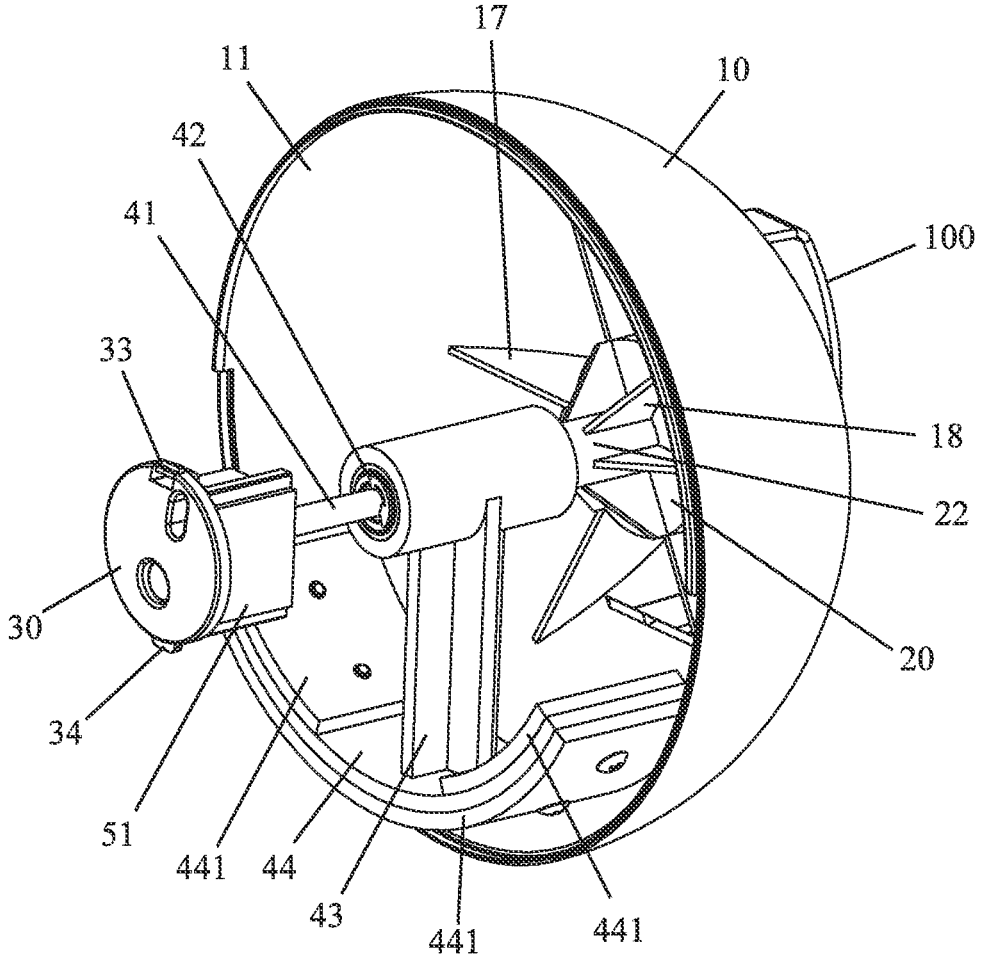
FIG. 4 is a partial perspective assembly view of the rotation exercising ball structure in accordance with the preferred embodiment of the present invention.
Figure 5:
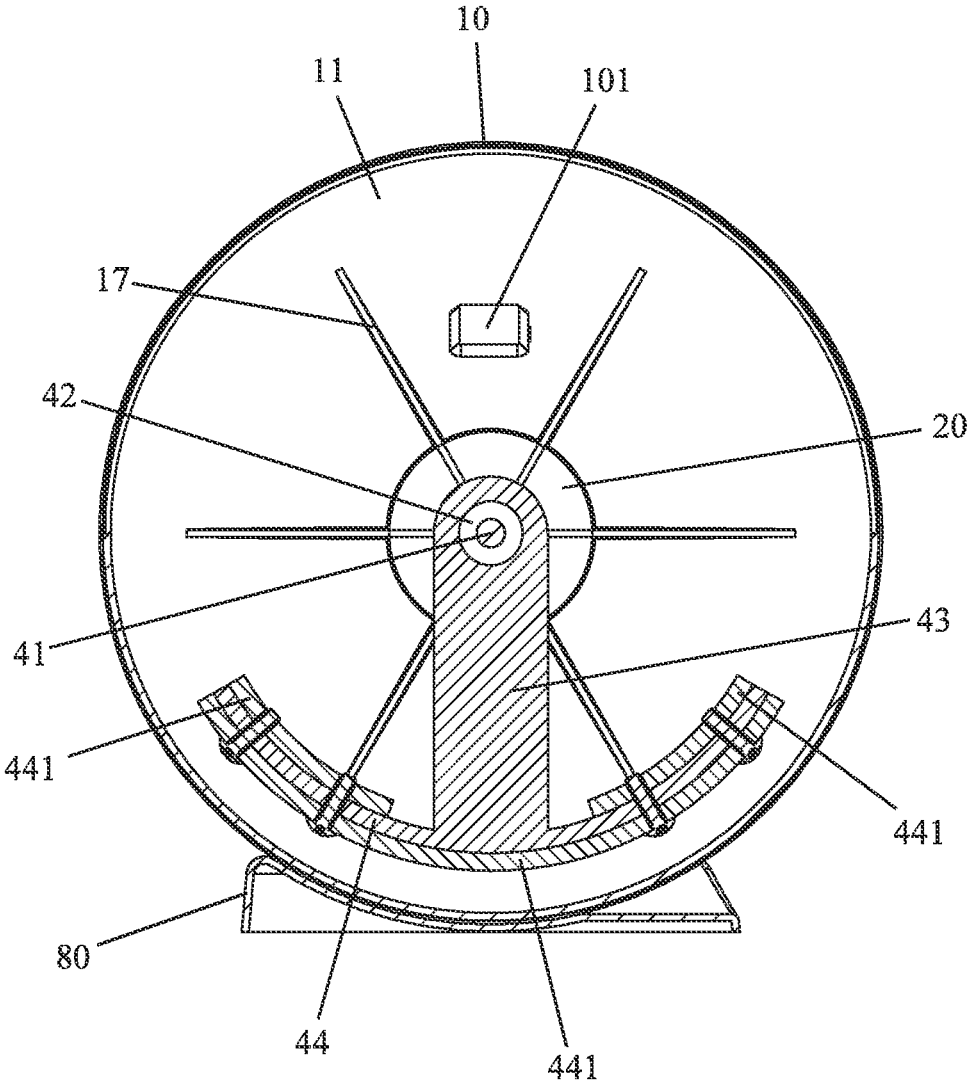
FIG. 5 is a side cross-sectional view of the rotation exercising ball structure as shown in FIG. 1.
Figure 6:
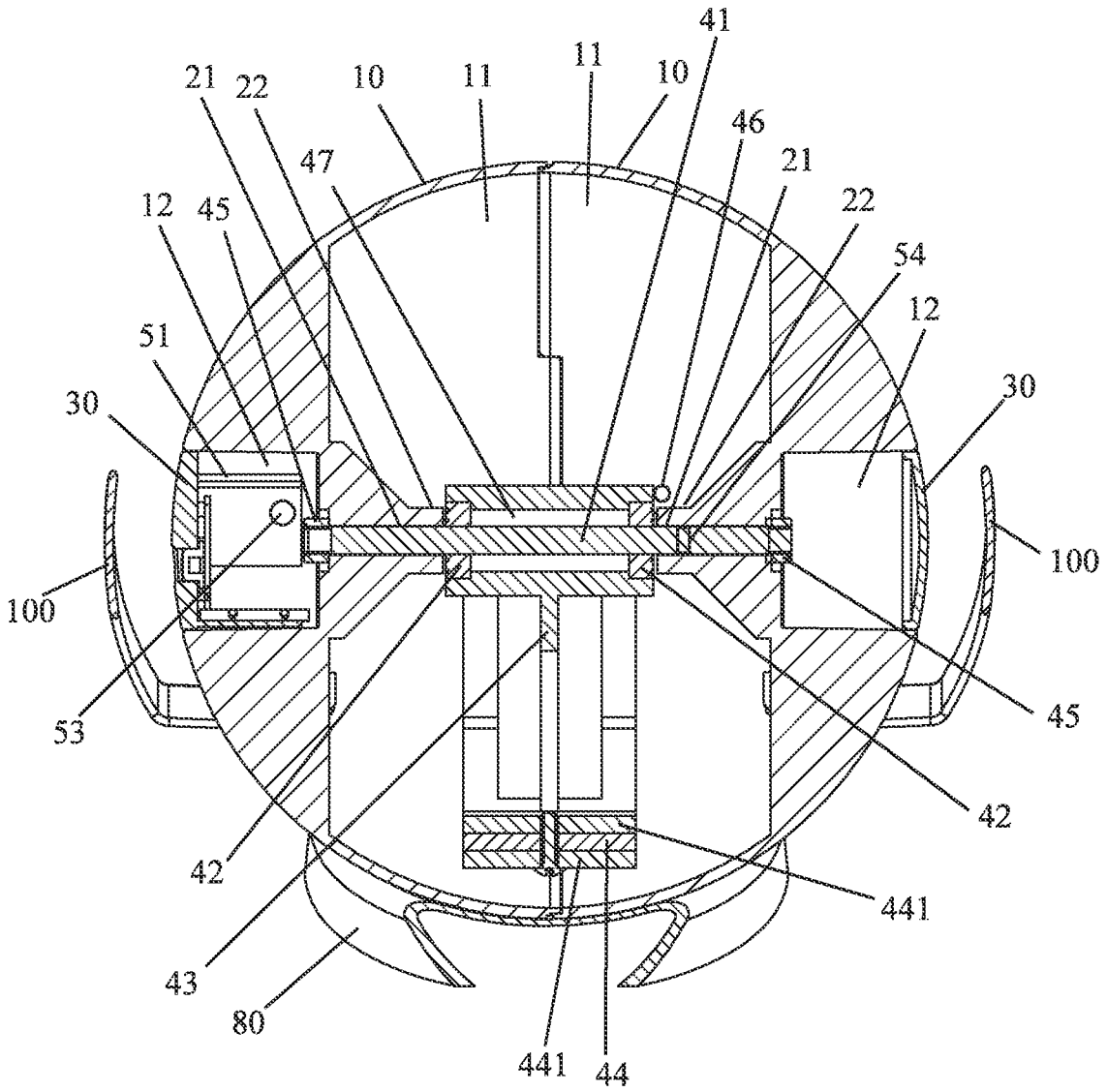
FIG. 6 is another side cross-sectional view of the rotation exercising ball structure as shown in FIG. 1.
Figure 7:
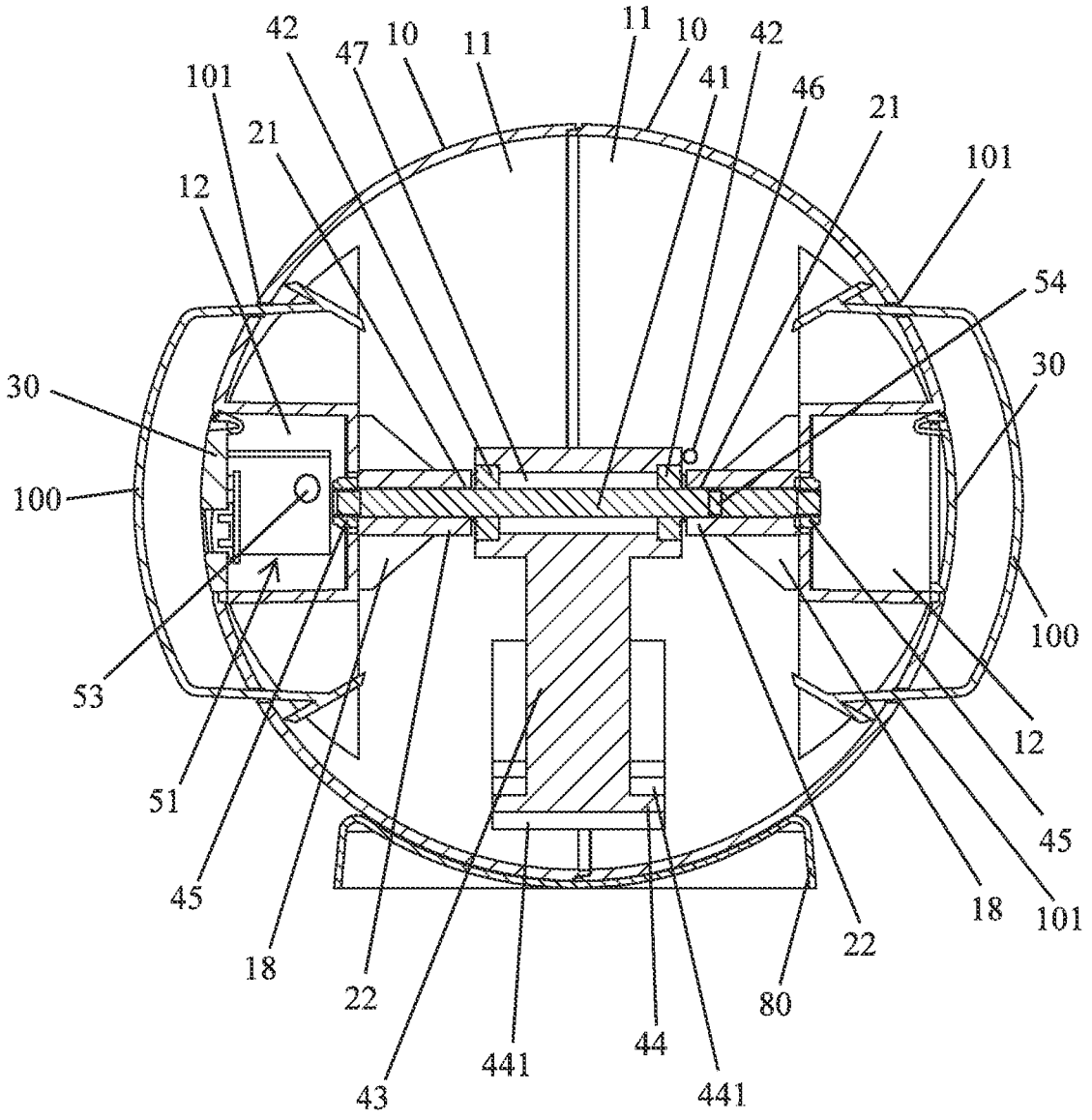
FIG. 7 is a further side cross-sectional view of the rotation exercising ball structure as shown in FIG. 1.

4. As shown in FIGS. 2, 4 and 5, the number of the auxiliary weights 441 on the weight 44 is adjusted according to the user's requirement to increase or decrease the centrifugal force of the weight 44 during rotation of the rotation member 43.

5. When the rotation member 43 is rotated, the two magnets 46 arranged on the mounting hole 47 of the rotation member 43 are also rotated with the rotation member 43. Then, the Hall sensor 54 mounted on the mandrel 41 will detect the information during rotation of the rotation member 43 and sends the information to the Bluetooth transmission device 53 which wirelessly transmits the information to an external portable electronic device. Thus, the information, such as the time interval, the swinging times, the calories consumed by the human body or the like, is transmitted to and recorded by the external portable electronic device.

6. The rotation exercising ball structure has fewer parts to reduce the cost of fabrication, and is assembled easily and quickly to decrease the expense, time, and manual work in assembly.

7. The two handle protecting members 100 are mounted on the two shells 10 of the hollow ball 1 respectively and align with the two holding members 30 respectively. Thus, when the user's two hands hold the two holding members 30 and apply a force to rotate and swing the hollow ball 1, the user's two hands are restricted by the two handle protecting members 100, to prevent the hollow ball 1 from being released from the user's two hands, and to prevent the hollow ball 1 from hurting other people.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A rotation exercising ball structure comprising:

two shells, two pivot seats, two holding members, a weight unit, and two handle protecting members;

wherein:

the two shells are combined together to construct a hollow ball;

each of the two shells has an interior provided with a space;

the space has a bottom provided with a fixing hole;

the fixing hole is located at a center of the bottom of the space and penetrates each of the two shells;

each of the two pivot seats is formed on the bottom of the space and directed toward an opening of one of the two shells;

each of the two pivot seats is provided with a pivot pillar;

the pivot pillar has a center provided with a through hole;

the through hole penetrates each of the two pivot seats and extends to the fixing hole;

the two holding members are mounted on the two shells respectively;

each of the two holding members covers the fixing hole of one of the two shells;

each of the two holding members has an inner side and an outer side;

the weight unit includes a mandrel, a rotation member, two bearings, a weight, and at least one auxiliary weight;

the mandrel has two ends each of which extends through the through hole of one of the two pivot seats;

each of the two ends of the mandrel is secured in the through hole of one of the two pivot seats;

the rotation member has a first end provided with a mounting hole;

the two bearings are mounted in the mounting hole of the rotation member;

the rotation member is radially mounted on a central position of the mandrel through the mounting hole;

the weight connects a second end of the rotation member and is located opposite to the mandrel;

the rotation member and the weight are rotated in the hollow ball radially and centrifugally with the mandrel served as an axis;

the at least one auxiliary weight is removably mounted on the weight; and the two handle protecting members are mounted on the two shells of the hollow ball respectively and align with the two holding members respectively.

2. The rotation exercising ball structure as claimed in claim 1, wherein the hollow ball is mounted on and supported by a base.

3. The rotation exercising ball structure as claimed in claim 1, wherein multiple first reinforcing ribs are formed between one of the two pivot seats and one of the two shells.

4. The rotation exercising ball structure as claimed in claim 1, wherein multiple second reinforcing ribs are formed between one of the two pivot seats and the pivot pillar.

5. The rotation exercising ball structure as claimed in claim 1, wherein:

each of the two holding members is provided with an elastic locking snap and a locking block; and the elastic locking snap and the locking block are locked in the fixing hole of one of the two shells.

6. The rotation exercising ball structure as claimed in claim 1, wherein each of the two ends of the mandrel extends through the through hole of one of the two pivot seats, and one of two nuts is screwed onto each of the two ends of the mandrel, so that each of the two ends of the mandrel is secured in the through hole of one of the two pivot seats.

7. The rotation exercising ball structure as claimed in claim 1, wherein the at least one auxiliary weight is locked onto and combined with a bottom of the weight by screws.

8. The rotation exercising ball structure as claimed in claim 1, wherein the at least one auxiliary weight is locked onto and combined with a top of the weight by screws.

9. The rotation exercising ball structure as claimed in claim 1, wherein:

the weight is provided with multiple receiving grooves;

each of the receiving grooves transversely penetrates the weight; and the weight unit includes multiple auxiliary weights mounted in the receiving grooves.

10. The rotation exercising ball structure as claimed in claim 1, further comprising:

a housing mounted on and combined with the inner side of one of the two holding members;

a Bluetooth transmission device mounted in the housing;

a Hall sensor mounted on the mandrel; and two magnets mounted on the rotation member;

wherein:

the housing is inserted into the fixing hole of one of the two shells;

the Bluetooth transmission device is electrically connected with the Hall sensor;

the Hall sensor is close to the mounting hole of the rotation member and aligns with the two magnets; and the two magnets are arranged at a periphery of the mounting hole.

11. The rotation exercising ball structure as claimed in claim 1, wherein each of the two shells of the hollow ball is provided with at least one connecting hole, and each of the two handle protecting members is secured on the at least one connecting hole of one of the two shells.

* * * * *